United States Patent [19]

Scheurecker

[11] 4,164,252

[45] Aug. 14, 1979

[54] STRAND GUIDING ROLLER FOR A CONTINUOUS CASTING PLANT

[75] Inventor: Werner Scheurecker, Linz, Austria

[73] Assignee: Vereinigte Österreichische Eisen- und Stahlwerke - Alpine Montan Aktiengesellschaft, Linz, Austria

[21] Appl. No.: 857,259

[22] Filed: Dec. 5, 1977

[30] Foreign Application Priority Data

Dec. 10, 1976 [AT] Austria ..... 9125/76

[51] Int. Cl.[2] ..... B22D 11/12; B65G 13/00

[52] U.S. Cl. ..... 164/448; 193/35 R

[58] Field of Search ..... 164/442, 448; 193/35 R, 193/35 B, 37; 308/20; 198/780, 789, 790, 791; 226/109, 185, 186, 190, 191-194; 29/116 R, 110, 124, 121.8

[56] References Cited

U.S. PATENT DOCUMENTS

| | | | |
|---|---|---|---|
| 1,989,988 | 2/1935 | Jones | 308/20 X |
| 3,964,658 | 6/1976 | Edwards | 226/190 |

FOREIGN PATENT DOCUMENTS 390286 2/1924 Fed. Rep. of Germany .

OTHER PUBLICATIONS

SKF (TSP No. 148) Belt Conveyors, Apr. 1941.

*Primary Examiner*—Richard B. Lazarus
*Assistant Examiner*—John S. Brown
*Attorney, Agent, or Firm*—Brumbaugh, Graves, Donohue & Raymond

[57] ABSTRACT

A strand guiding roller to be used for a continuously cast strand includes a plurality of roller bodies designed as exchangeable wear sleeves and arranged on a drivable shaft at a distance from each other, a plurality of bearings distributedly arranged over the length of the roller to rotatably accommodate the drivable shaft therein, and catch connections provided between the exchangeable wear sleeves and the drivable shaft to secure the exchangeable wear sleeves against rotation.

3 Claims, 3 Drawing Figures

STRAND GUIDING ROLLER FOR A CONTINUOUS CASTING PLANT

BACKGROUND OF THE INVENTION

The invention relates to a strand guiding roller for a continuous casting plant for supporting, bending, straightening and deforming a continuously cast strand, in particular a steel slab, which guiding roller has a plurality of roller bodies and a plurality of bearings distributedly arranged over the length of the roller.

It has been known to form such a strand guiding roller from roller bodies which are received one within the other, wherein the roller bodies are held together by a bracing anchor. The bearings of this roller are arranged on offset portions of the roller bodies that serve as bearing pins. For mutual centering the roller bodies comprise centering, recesses as well as projections fitting into these recesses. The bearing pins, centering recesses and projections must be carefully machined, thus leading to extra expense in the production of the roller bodies.

Since the roller bodies, in particular those arranged in the middle of the roller, are subject to a high degree of wear and thus are parts of the plant that have to be exchanged quite frequently, it is desirable to design the roller bodies as simply as possible and to possibly avoid surfaces that have to be produced with the utmost precision and with close fits. Besides, the roller bodies should be produceable in as few a number of working steps as possible.

On the other hand, it has been known to rotatably arrange sleeve-like roller bodies at a distance from each other on a fixed axis supported by axis holders, separate bearings being provided between the axis and the roller bodies, however. Such roller bodies cannot be driven together and their utilization and wear are not uniform.

SUMMARY OF THE INVENTION

The invention has as its object to provide a strand guiding roller of the above-defined kind whose roller bodies are simply designed and are produceable with little expenditure. The advantages of the known strand guiding roller, which are, among others, that the roller can be driven despite its multiple-part design and its journaling at several places of its longitudinal extension, shall, however, be maintained.

According to the invention, these objects are achieved by forming the roller bodies as exchangeable wear sleeves which are fastened on a drivable shaft at a distance from each other by catch connections so as to be secured against rotation, the drivable shaft being rotatably arranged in bearings located between the wear sleeves.

According to a preferred embodiment, the shaft has the same diameter over its total length, the fits provided between the bearings or the roller bodies, respectively, and the shaft are taken from the "basic shaft" system.

Advantageously, the bearings are designed as antifriction bearings with a one-part inner race and an outer race designed in two parts, wherein one part of the outer race is formed by a half-race inserted in a bearing housing lower part and the other part is formed by a bearing lid fastened to the bearing housing lower part.

BRIEF DESCRIPTION OF THE DRAWINGS

The invention shall now be described in more detail by way of several embodiments and with reference to the accompanying drawing, wherein.

DESCRIPTION OF THE PREFERRED EMBODIMENTS

Figure 1:
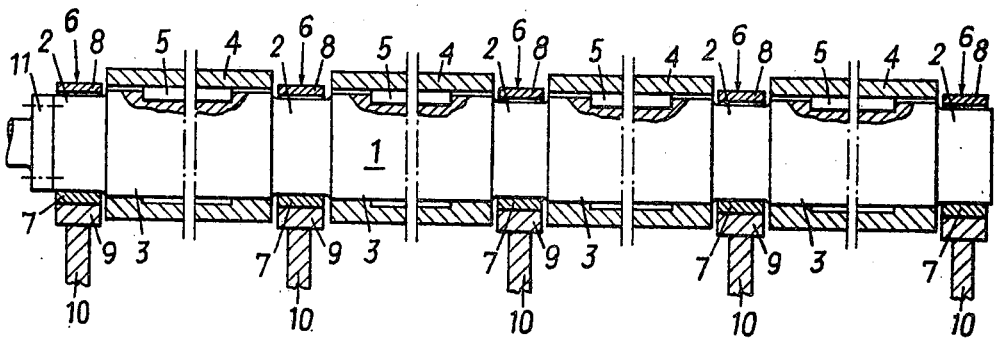
FIGS. 1 and 2 are each a schematically illustrated axial section through strand guiding rollers according to alternative embodiments and FIG. 3 is a sectional illustration of a further embodiment of the invention, wherein the plane of the section is perpendicular to the longitudinal direction of the strand guiding roller and through a bearing place of the same.

A shaft 1 of a strand guiding roller according to FIG. 1 is provided with bearing seats 2 arranged one beside the other and at a distance from each other. Between these bearing seats 2, seats 3 having a somewhat larger diameter than the bearing seats 2 have provided for roller bodies 4 to be pushed on the shaft 1. The roller bodies 4, designed as wear sleeves, are each secured on the shaft against rotation by a feather key 5 or another catch connection. The bearings 6 arranged between the roller bodies 4 and at the ends of the roller are designed as slide bearings, each containing a bearing half-shell 7. The housing 9 of each bearing fastened to a carrier 10 is closed by a lid 8. A driving motor (not illustrated herein) is detachably fastened to the shaft via a driving flange 11.

As can be seen from FIG. 1, the roller bodies are simply formed like hollow cylinders with circular cross sections. The inner bore of each roller body accommodating the shaft fits the shaft only at the ends of each roller body, each fit corresponding to the seat 3 of the shaft, whereas the part of the roller body inbetween the ends has a somewhat larger diameter than the shaft in this region.

Figure 2:
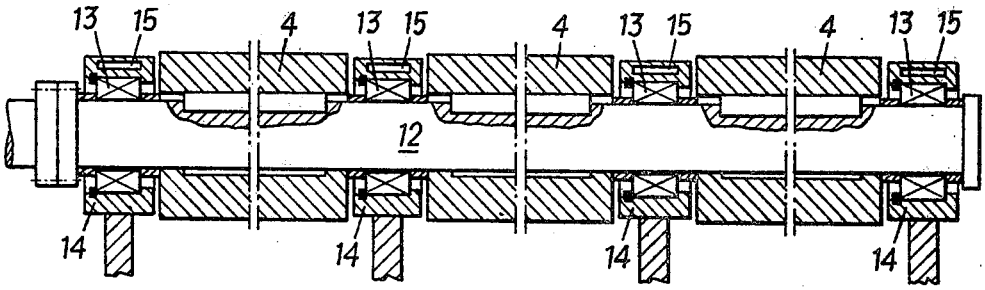

According to the embodiment illustrated in FIG. 2, the shaft 12 of the strand guiding roller has the same diameter over its total length, while the antifriction bearings 13 as well as the hollow-cylinder shaped roller bodies 4 provided in this embodiment show different fits relative to the shaft, which fits are taken from the "basic shaft" system (Lueger, 1960, Vol. 1, page 96). The advantage of this embodiment is primarily that the bearings 13 can be designed as one piece, thus leading to a simple construction. The bearing housings 14 of the bearings 13, according to FIG. 2, are also designed in one piece. On the side facing the surface of the strand the bearing housings are each provided with a duct 15 through which a cooling agent flows.

Figure 3:
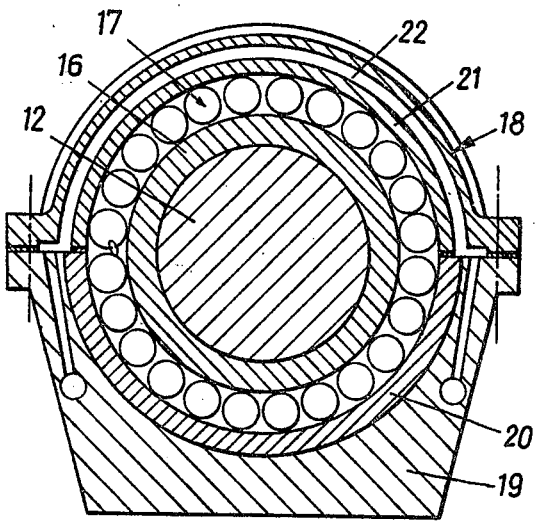

The embodiment illustrated in FIG. 3 also shows a strand guiding roller in which the fits between the shaft 12 and the inner races 16 of the antifriction bearings 17 and the roller bodies are taken from the "basic shaft" system.

The outer race 18 of the antifriction bearings is comprised of two parts. It is formed by a half-race 20 inserted in the lower part 19 of the bearing housing and a bearing lid 21 detachably fastened to the lower part 19 of the bearing housing. The half-race 20 inserted in the lower part 19 of the bearing housing has to accommodate the forces coming from the strand; the lid 21 of the bearing housing needs to accommodate only part of the strand guiding roller's own weight, if the roller is used for supporting the upper side of the strand. This embodiment has the advantage that only a little room in the direction of the upper surface of the strand is needed by the bearing 17, since one construction part takes over the function of the lid of the bearing housing as well as that of the outer race of the antifriction bearing. By this configuration it is possible to use rollers with particularly small diameters and bearings with diameters relatively large compared to those of the rollers. The bearing lid 21 in this embodiment is also provided with a duct 22 through which a cooling agent flows.

What I claim is:

1. In a strand guiding roller to be used in a continuous casting plant for supporting, bending, straightening and deforming a continuously cast strand, in particular steel slab, wherein said strand guiding roller has a plurality of roller bodies and a plurality of bearings distributed over the length of said strand guiding roller, the improvement which is characterized in that a drivable shaft is provided, said plurality of roller bodies being designed as exchangeable wear sleeves and being arranged on said drivable shaft at a distance from each other, catch connections being provided to fasten said exchangeable wear sleeves on said drivable shaft so as to secure said exchangeable wear sleeves against rotation with respect to said shaft, and said bearings being provided intermediate said exchangeable wear sleeve to rotatably accommodate said drivable shaft therein and to support said shaft at a number of places along its longitudinal extension.

2. A roller as set forth in claim 1, wherein said drivable shaft has a certain length and an equal diameter over all of said length and wherein fits are provided between said bearings and said drivable shaft and between said wear sleeves and said drivable shaft, which fits are designed in "basic-shaft"-system manner.

3. A roller as set forth in claim 2, wherein said bearings are designed as antifriction bearings, each bearing including a one-part inner race, a two-part outer race, and a bearing housing having a bearing housing lower part and a bearing lid detachably fastened to said bearing housing lower part, one part of said two-part outer race being formed by a half-race inserted in said bearing housing lower part, and the other part of said two-part outer race being formed by said bearing lid.

* * * * *